US008523563B1

(12) United States Patent
Nardella

(10) Patent No.: US 8,523,563 B1
(45) Date of Patent: Sep. 3, 2013

(54) KILN BRICK PROTECTIVE COLLAR

(76) Inventor: Anthony Nardella, Medford, MA (US)

( * ) Notice: Subject to any disclaimer, the term of this patent is extended or adjusted under 35 U.S.C. 154(b) by 1215 days.

(21) Appl. No.: 12/350,064

(22) Filed: Jan. 7, 2009

Related U.S. Application Data

(60) Provisional application No. 61/010,195, filed on Jan. 7, 2008.

(51) Int. Cl.
*F27D 1/18* (2006.01)

(52) U.S. Cl.
USPC ..... 432/237; 432/250; 110/181; 202/224

(58) Field of Classification Search
USPC ..... 432/56, 57, 237, 250; 110/172, 110/173 R, 181; 48/124, 126; 49/462; 202/224; 219/385, 420, 438, 456.1
See application file for complete search history.

(56) References Cited

U.S. PATENT DOCUMENTS 4,295,825 A * 10/1981 Chielens et al. ..... 432/116
4,370,128 A * 1/1983 Chielens et al. ..... 432/115
5,193,998 A * 3/1993 Hack et al. ..... 432/250
5,477,029 A * 12/1995 Skutt et al. ..... 219/390
5,734,149 A * 3/1998 Skutt et al. ..... 219/390
5,910,006 A * 6/1999 Conroy et al. ..... 432/250
6,228,224 B1 * 5/2001 Brooker ..... 202/224
6,805,773 B1 * 10/2004 Brooker ..... 202/224
7,458,809 B2 * 12/2008 Hohenshelt et al. ..... 432/120
2009/0042157 A1 * 2/2009 Kelly ..... 432/250
2010/0021856 A1 * 1/2010 Couse et al. ..... 432/250
2010/0209865 A1 * 8/2010 Watson et al. ..... 432/250

* cited by examiner

*Primary Examiner* — Gregory A Wilson
(74) *Attorney, Agent, or Firm* — O'Connell Law Firm; Thomas P. O'Connell

(57) ABSTRACT

A protective collar for a kiln that has a rigid body portion and a shape and size substantially corresponding to the shape and size of at least a portion of the peripheral edge surface of the kiln sidewall. Depending on the kiln, the protective collar can be round, oval, faceted, or otherwise shaped. The collar can be a complete ring or just a portion thereof. A plurality of stops, which can be fixed or pivoting, spaced along the body portion of the protective collar can prevent dislocation of the collar when applied to the kiln. The stops can be adjustable in location to avoid obstructions on the kiln. A properly selected protective collar can enable a method for protecting the fire-brick in a kiln where the protective collar is applied with the shapes of the protective collar and the peripheral edge surface of the kiln sidewall substantially aligned.

27 Claims, 6 Drawing Sheets

KILN BRICK PROTECTIVE COLLAR

PRIORITY

This application claims priority to Provisional Patent Application No. 61/010,195, filed Jan. 7, 2008.

FIELD OF THE INVENTION

This invention relates generally to kilns. More particularly, disclosed and protected herein is a protective collar for kilns that prevents wear and damage to the upper peripheral edge surface of the kiln during loading and unloading.

BACKGROUND OF THE INVENTION

Kilns are essential to the manufacture of ceramics, which, by definition, require high temperature treatment. During the firing stage, chemical and physical reactions occur that permanently alter the material. Proper firing of clay converts the relatively weak and malleable substrate into a rigid and strong structure. The final material characteristics of articles of ceramic are determined by a number of factors, including the preparation and composition of the clay substrate, the temperature at which it is fired, and any glazing that might be applied thereto.

One type of kiln often used by finished ware manufactures to fire ceramic products is commonly referred to as a hobby kiln, which can be used for firing, curing, and heat treating. Kiln styles include the chamber raise kiln, the top loading kiln, and the front loading kiln. The chamber raise kiln is often referred to as a top hat kiln since an upper body portion with sides, a top, and an open bottom is raised and lowered by a winch system relative to a support surface for enabling the insertion, heat treatment, and removal of articles. A front loading kiln typically comprises a box shape with a vertically hinged front door.

Top loading kilns are perhaps the most common type of hobby kiln. A typical top loading kiln is indicated generally at 10 in FIG. 1. The top loading kiln 10 has a body portion formed by a fixed peripheral sidewall 12 and a bottom 25. The sidewall 12 and the bottom 25 together define a firing chamber 16 for receiving articles to be heat treated. A lid 14 with a handle 32 is coupled to the sidewall 12 by a hinge arrangement 18. The lid 14 can be retained in an open disposition by a support bar 22 or other means. When closed, the lid 14 seals off the chamber 16 to enable proper heating of the kiln 10.

The sidewalls 12 of top loading kilns 10 can be of a variety of shapes, including round as in FIG. 4, square, oval, or faceted, such as by having from five to twenty or even more facets. For example, the kiln 10 in FIG. 1 is faceted with ten sides while the kiln 10 in FIG. 3 is faceted with eight sides. The thickness T of the sidewalls 12 can vary, but is commonly 2 and ½ to 3 and ½ or more inches. Similarly, the effective inner diameter D of kilns 10 varies depending on, among other things, the needs and budget of the artisan and the design of the manufacturer.

Electric heating elements 20, often made from resistance wire, are disposed in grooves 21 on the interior surfaces of the sidewalls 12. The kiln 10 receives power through a power cord 30. Other kilns 10 are gas fired. A control box 24 with a control panel 28 enables control over the operation of the kiln 10, and a plurality of venting louvers 26 enables heat to be dissipated from the control box 24. The sidewall 12, lid 14, and bottom 25 of the kiln 10 are typically formed by blocks of firebrick, which can be dry fit or cemented together. The firebrick can be enveloped in a metal lining.

Firebrick is a refractory ceramic material built primarily to withstand high heat and to demonstrate low thermal conductivity, which saves energy and facilitates sustained high internal operating temperatures. In that regard, it will be noted that kilns 10 are fired not just to a temperature, but to what are typically referred to as cone levels, which account for time and temperature. The firebrick used in electric and gas-fired kilns 10 is often relatively porous thereby rendering the brick lighter, easier to form, and better thermal insulators than denser brick.

The sidewall 12 of the top loading kiln 10 has an upper peripheral surface 15 that is flat and horizontal for providing a good seal relative to the lower surface of the lid 14. A tight seal is important for a number of reasons, including for energy efficiency and to enable the kiln 10 to reach desired cone levels. Furthermore, a good seal will help prevent caustic fumes from escaping from the firing chamber 16 and causing adverse effects on bystanders and surrounding components of the kiln 10. Furthermore, certain kilns 10 rely on a tight seal to permit a negative pressure to be created by a downdraft vent system that, when installed and operational, limits the emission of fumes by evacuating them from the chamber 16 and exhausting them.

Unfortunately, while advantageous for its thermal and other properties, firebrick is very fragile. As such, the soft brick is vulnerable to chipping, breaking, and general wear. For example, as artisans repeatedly lean against the sidewalls 12 to reach into the firing chamber 16, the firebrick at the upper peripheral edge surface 15 is often worn down over time and otherwise damaged. Furthermore, articles, such as ceramic structures and kiln furniture, can accidentally strike and damage the upper edge surfaces 15 of the sidewalls 12 while being inserted and removed. Further risk of damage and wear comes from the habit of some practitioners of propping the lid 14 of their kiln 10 open by placing a brick or other obstruction between the lid 14 and the upper edge surface 15 of the sidewall 12.

Over time, therefore, a wearing away of the upper peripheral edge surface 15 leads to chips 36 and damaged edge portions 34. The integrity of the seal between the lid 14 and the upper peripheral edge surface 15 can be compromised, particularly where the damage extends entirely from the inner edge to the outer edge of the upper peripheral edge surface 15, thereby leading to reduced performance and potential harm to surrounding persons and structures. While repair of the damaged peripheral edge surface 15 is possible, it is expensive and inevitably decreases the life and value of the kiln 10.

With an awareness of the problems and dangers deriving from such damage to the upper peripheral edge surfaces 15 of kilns 10, it has been appreciated by the present inventor that a structure and method for protecting a kiln 10 during loading and unloading would represent a useful advance in the art.

SUMMARY OF THE INVENTION

The present inventor set forth with the basic object of providing a protective collar for kilns that prevents wear and damage in relation to the upper surface of the kiln.

A related object of the invention is to provide a protective collar for kilns that increases the useful life of the kiln and reduces the need for repairs thereto.

A further object of embodiments of the invention is to provide a protective collar for kilns that enables a tight seal between the lid and the upper surface to be maintained thereby improving energy efficiency and firing quality while preventing the deleterious effects of escaping gasses.

Another object of the invention is to provide a protective collar for kilns that permits full or substantially full dimensional access to the firing chamber for loading and unloading while protecting the fragile firebrick at the upper surface of the kiln.

Still another object of the invention is to provide a protective collar for kilns that reduces the care and attention required in leaning over the kiln thereby improving comfort and ease while saving precious time in loading and unloading articles relative to the kiln.

These and in all likelihood further objects and advantages of the present invention will become obvious not only to one who reviews the present specification and drawings but also to those who have an opportunity to observe an embodiment of the protective collar for kilns disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the foregoing objects, one embodiment of the invention for a protective collar for a kiln that has a peripheral kiln sidewall with a peripheral edge surface of a given shape, size, and thickness comprises a rigid body portion with an upper surface, a lower surface, an inner edge, an outer edge, and a shape and size substantially corresponding to the shape and size of at least a portion of the peripheral edge surface of the kiln sidewall. It is clear, therefore, that the shape and size of the body portion of the protective collar will vary depending on the shape and size of the sidewall of the kiln to be protected. Consequently, a kiln with a peripheral edge surface with a faceted shape will warrant a protective collar with a body portion having a given number of facets substantially corresponding in size, shape, and disposition to at least some of the facets of the peripheral edge of the kiln sidewall. For example, a kiln with eight facets will beget a protective collar having eight facets, a kiln with 10 facets will beget a protective collar with ten facets, and so on. Together, the kiln and the protective collar can be considered a combination yielding protection to the kiln not known to the prior art.

The body portion, which may or may not form a complete ring, can have a width approximately equal to the thickness of the peripheral edge surface of the kiln sidewall, an inner dimension between opposed inner edges approximately equal to an inner dimension between opposed inner edges of the peripheral edge surface, and an outer diameter between opposed outer edges approximately equal to an outer dimension between opposed outer edges of the peripheral edge surface. In certain embodiments, the body portion can have a width within thirty percent of the thickness of the peripheral edge surface of the kiln sidewall.

Means for preventing dislocation of the protective collar relative to the peripheral edge surface of the kiln sidewall when the protective collar is applied in alignment with the peripheral edge surface of the kiln sidewall can additionally be incorporated. That means can comprise a means for preventing sliding in a first direction over the upper peripheral edge surface when the protective collar is applied in alignment with the peripheral edge surface while permitting sliding in a second direction opposite the first direction off of the peripheral edge surface. In certain embodiments, the means can comprise at least one stop fixed to the body portion that has a portion that projects beyond the lower surface of the body portion. For example, there can be a plurality of stops spaced over less than a 180-degree span along the body portion of the protective collar.

To facilitate shipping and storage and potentially to avoid obstructions on the kiln, the stops could be pivotable from a first position where stops do not project beyond the lower surface of the body portion and a second position where the stops project beyond the lower surface of the body portion. In one such embodiment, the stops can be L-shaped with a first leg received into a borehole in the outer edge of the body portion and a second leg pivotable from a first position where the second leg does not project beyond the lower surface of the body portion and a second position where the second leg projects beyond the lower surface of the body portion. Still further, it is contemplated that means can be provided for permitting alternate positioning of the stops, such as by having alternate boreholes or fastening apertures to which the stops can be secured.

As disclosed herein, the protective collar can enable a method for protecting the peripheral edge surface of the kiln. One would provide a kiln with a peripheral kiln sidewall that has a peripheral edge surface of a given shape, size, and thickness, select a protective collar with a rigid body portion with an upper surface, a lower surface, an inner edge, an outer edge, and a shape and size approximately corresponding to the shape and size of at least a portion of the peripheral edge surface of the kiln sidewall, and apply the protective collar to the kiln with the lower surface of the body portion facing the peripheral edge surface of the kiln sidewall and with the shapes of the protective collar and the peripheral edge surface substantially aligned. With the protective collar so applied, a loading of articles relative to the kiln can be undertaken with minimized risk of damage to the fragile firebrick of the kiln sidewall.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

As is the case with many inventions, the present invention for a protective collar for kilns is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction and illustrations of inventive concepts are mere examples of the many possible manifestations of the invention.

Figure 5:
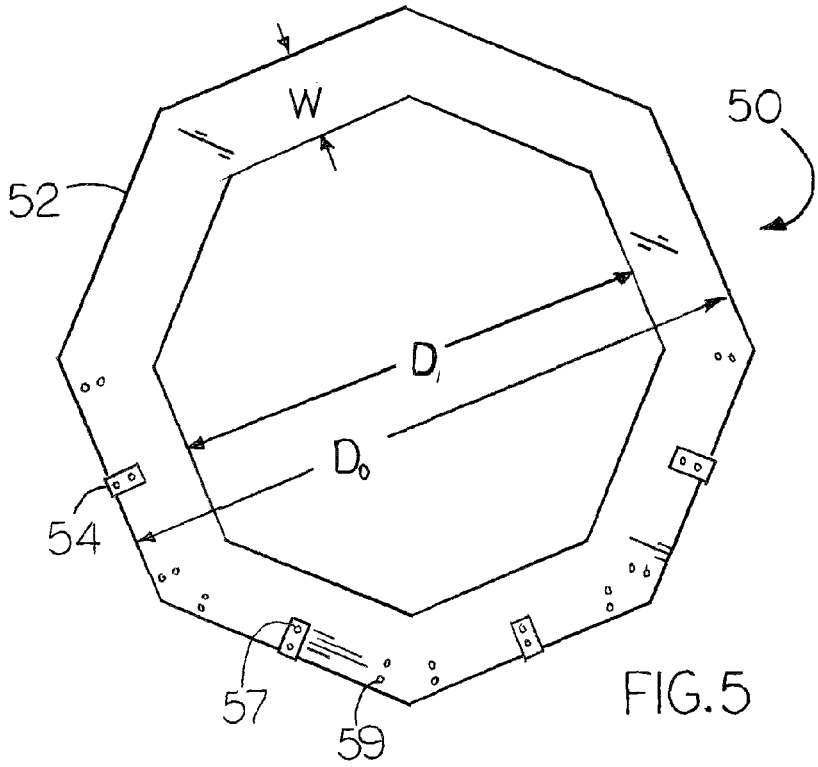
FIG. 5 is a top plan view of a protective collar for kilns according to the present invention.
Figure 6:
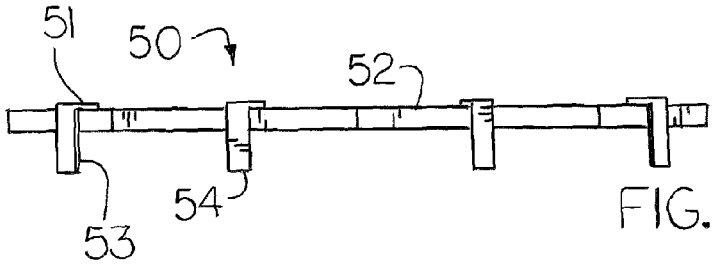
FIG. 6 is a view in front elevation of the protective collar of FIG. 5.
Figure 7:
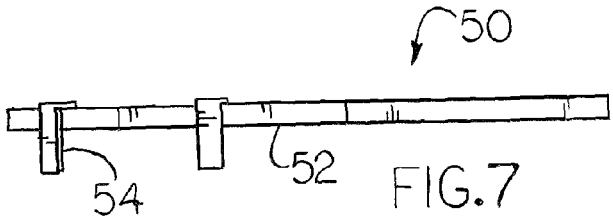
FIG. 7 is a view in side elevation of the protective collar of FIG. 5.

As noted above, the present inventor's basic object is to provide a protective collar for kilns that prevents wear and damage in relation to the upper surface of the kiln. An embodiment of such a protective collar is indicated generally at 50 in FIGS. 5 through 7. There, one can see that the protective collar 50 is founded on a body portion 52. In the depicted embodiment, the body portion 52 forms a complete ring. The body portion 52 is substantially flat with what can be considered an upper flat surface and a lower flat surface. The body portion 52 has a width W, an inner dimension $D_I$ measured as the distance between opposed inner edges, and an outer diameter $D_O$ measured as the distance between opposed outer edges.

The body portion 52 can be formed from any suitable material or combination of materials. In certain contemplated embodiments, the body portion 52 can be crafted from wood, such as a panel of plywood or from multiple pieces of wood coupled in any suitable manner. Other potential materials include metal, temperature resistant polymeric material, or any suitable resinous or composite material. In any event, the body portion 52 is preferably sufficiently rigid to resist bending and able to withstand elevated temperatures.

Figure 1:
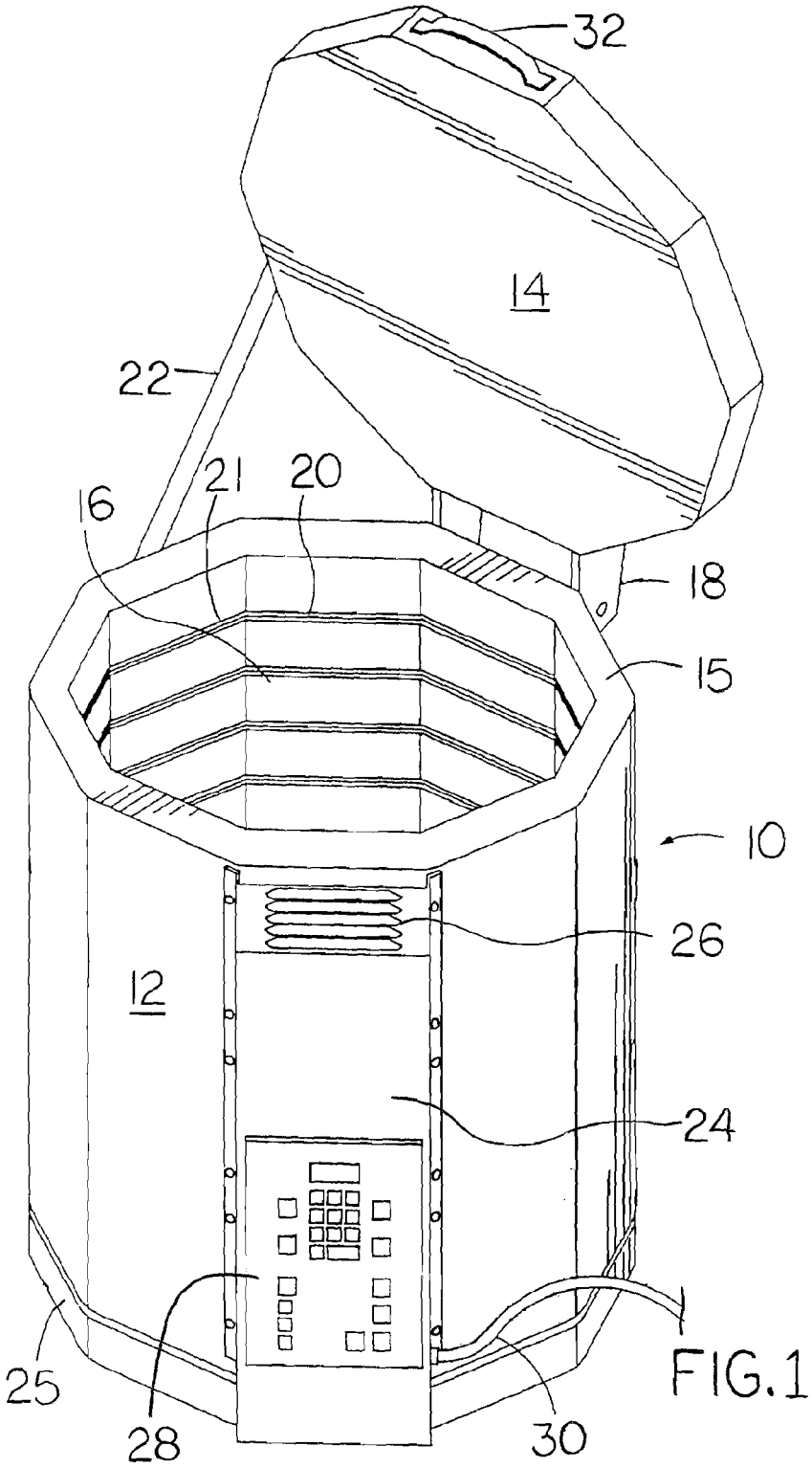
FIG. 1 PRIOR ART
FIG. 1 is a perspective view of a top loading kiln according to the prior art.
Figure 2:
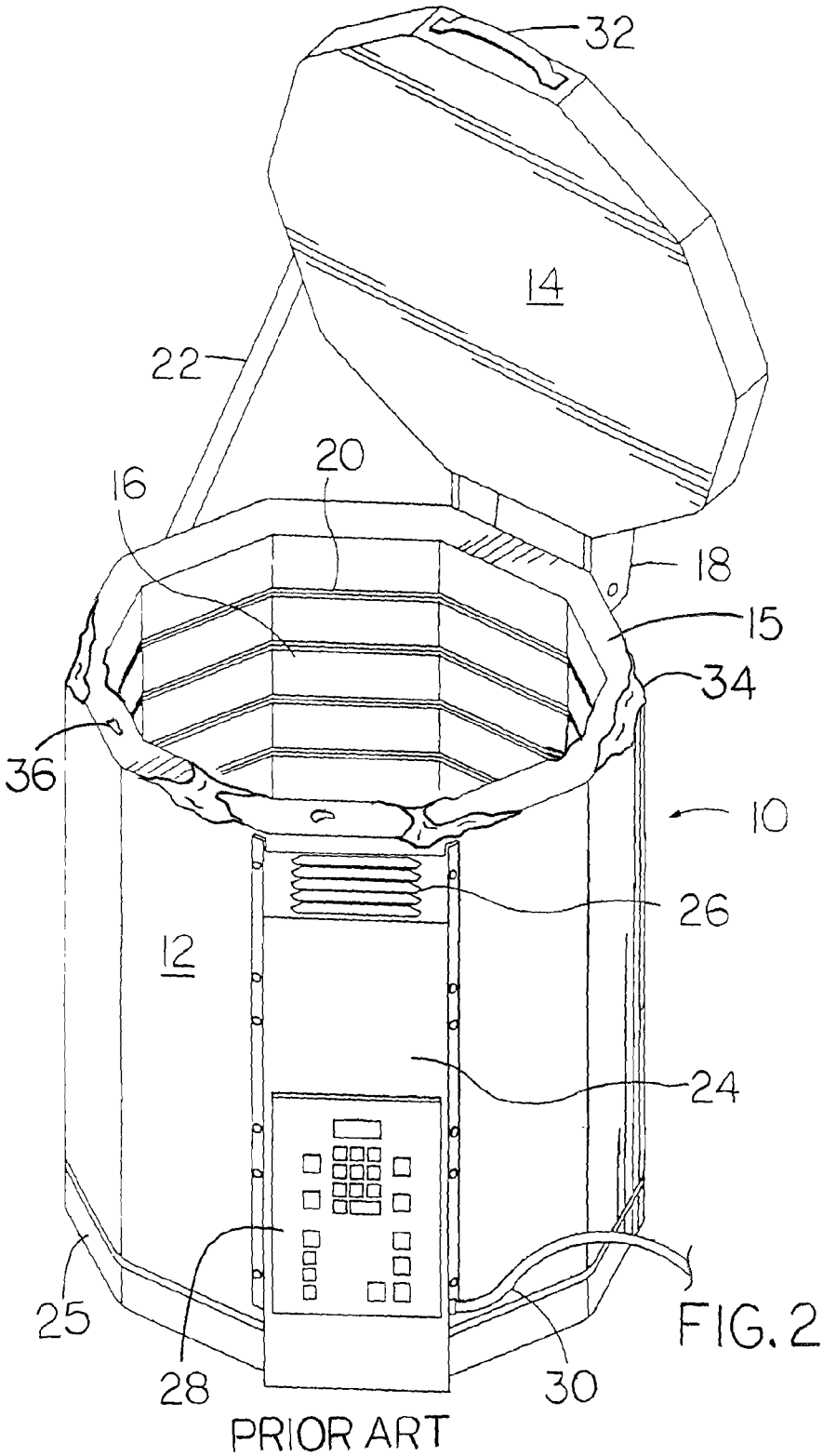
FIG. 2 PRIOR ART
FIG. 2 is a perspective view of the kiln of FIG. 1 after a period of use.
Figure 3:
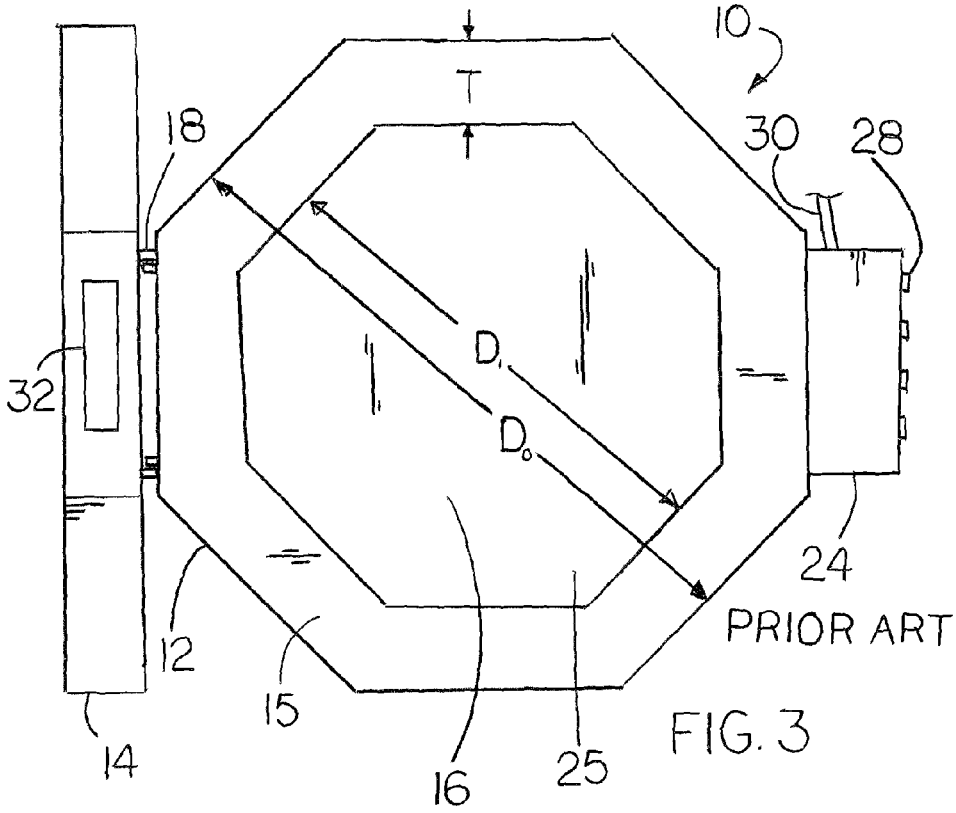
FIG. 3 is a top plan view of another top loading kiln as disclosed by the prior art.

The body portion 52 can have a shape and size corresponding to the shape and size of the upper peripheral edge surface 15 of the kiln 10 with which the protective collar 50 is to be used. Therefore, the octagonal protective collar 50 depicted in FIGS. 5 through 7 would ideally be applied to a kiln 10 with an octagonal sidewall 12 as shown in FIG. 3. The protective collar 50 can have an inner dimension $D_I$ between opposed inner edges approximately equal to or within a predetermined range of an inner dimension $D_I$ between opposed inner wall surfaces of the kiln sidewall 12 and an outer dimension $D_O$ between opposed outer edges approximately equal to or within a predetermined range of an outer dimension $D_O$ between opposite outer wall surfaces of the kiln sidewall 12, possibly including or not including insulation. With that, the width W of the protective collar 10 can be approximately to the thickness T of the sidewall 12, potentially including or not including insulation and other materials.

Figure 8:
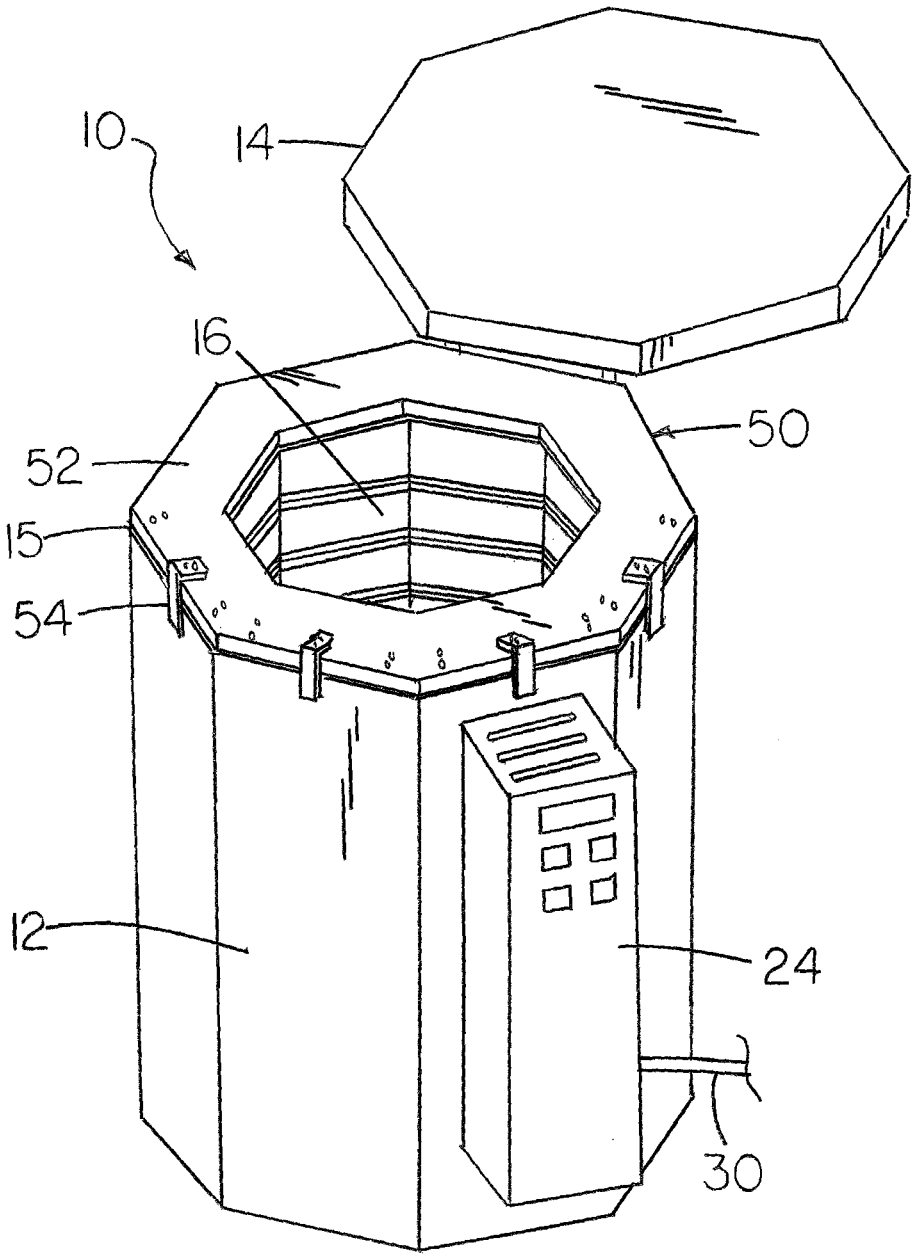
FIG. 8 is a perspective view of a protective collar pursuant to the invention disclosed herein applied to a top loading kiln.

So shaped and sized, the protective collar 50 can be applied to the kiln 10 during periods of loading, unloading, maintenance, and the like as shown in FIG. 8 with the lower surface of the protective collar 50 resting atop and substantially overlying the upper peripheral edge surface 15 of the kiln sidewall 12. The legs and corners of the protective collar 50 can be aligned with the legs and corners of the sidewall 12. With that, a kiln operator can be provided with full access to the firing chamber 16 while the firebrick forming the upper peripheral edge surface 15 is protected against impact, chipping, and general wear.

Figure 4:
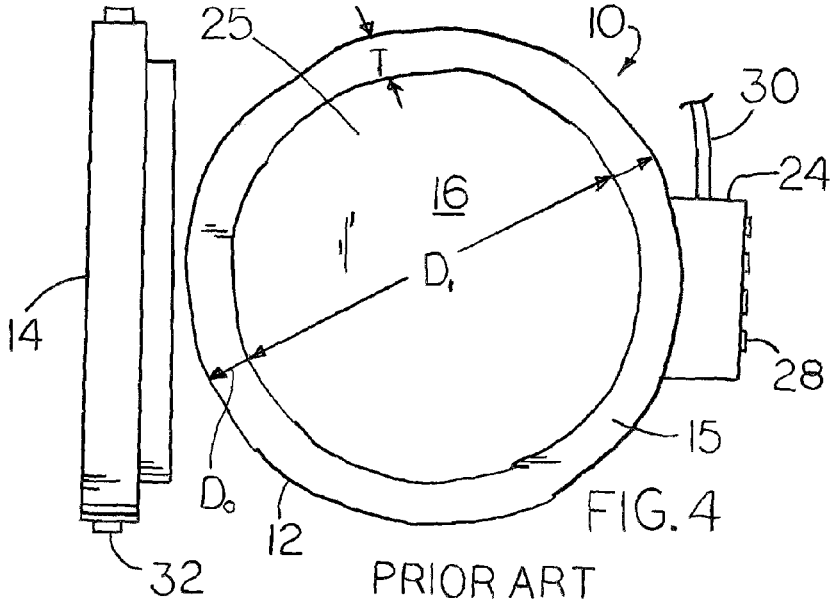
FIG. 4 is a top plan view of a further top loading kiln according to the prior art.
Figure 10:
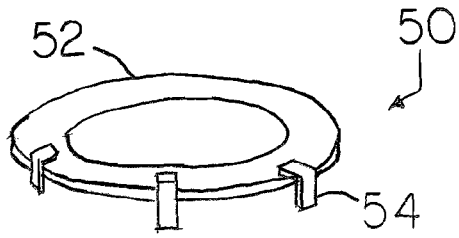
FIG. 10 is a perspective view of a protective collar according to the present invention designed for use in relation to a round kiln.

Protective collars 50 according to the invention will thus ideally substantially mirror in shape and size the shape and size of the upper peripheral edge surface 15 of the sidewall 12 of the kiln 10 to which the collar 50 is to be applied. By way of example and not limitation, a pentagonal collar 50 will be provided for a pentagonal kiln 10, a twelve-sided collar 50 will ideally be provided for a twelve-sided kiln 10, an oval or round collar 10 as shown in FIG. 10 will ideally be provided for an oval or round kiln 10 as shown in FIG. 4. The inner and outer dimensions $D_I$ and $D_O$ will approximately correspond such that the width W of the collar 50 will approximately match the thickness T of the kiln sidewall 12.

It is preferred for the collar 50 to match the shape of each kiln 10 and to be within a given range of, such as within thirty percent (30%) greater or less than, the thickness T of the sidewall 12. For example, a collar 50 for a kiln 10 with a 2 and ½ inch sidewall 12 might acceptably have a thickness T between 1.75 and 3.25 inches while a collar 50 for a kiln 10 with a 3 inch sidewall 12 might have a thickness T between 2.1 and 3.9 inches.

Figure 9:
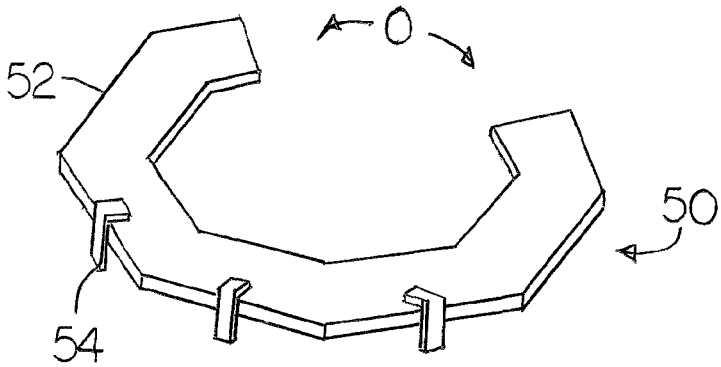
FIG. 9 is a perspective view of an alternative protective collar under the present invention.

For a number of reasons, it may be preferable to form the protective collar 50 as a complete ring capable of entirely circumscribing the firing chamber 16. For example, a complete ring may demonstrate greater rigidity and will be less likely to present an edge that might be harmful to the firebrick forming the sidewall 12 and the lid 14. However, as one will appreciate with further reference to FIG. 9, it is within the scope of the invention for the body portion 52 of the protective collar 50 to be an incomplete ring with an open portion 0, which could be a narrow slot or could span a substantial portion of the circumference of the body portion 52. Preferably, though, the body portion 52 will span at least 120 degrees and more preferably 180 degrees or half of the circumference of the upper surface 15 of the sidewall 12 to permit adequate coverage and protection thereof.

The protective collar 50 could be applied with the goal of having its alignment and general position maintained by mere friction with repositioning carried out as necessary. However, embodiments are contemplated wherein means are provided for preventing sliding of the protective collar 50 relative to the upper peripheral surface 15 of the sidewall 12. In certain embodiments, once the collar 50 is fully applied to the kiln 10, the means can prevent relative sliding in a first direction while permitting relative sliding in a second, opposite direction. With that, the protective collar 50 can be applied to the upper peripheral edge surface 15, and sliding in a first direction, such as away from the artisan, can be prevented while sliding in a second, opposite direction, such as toward the artisan and off of the upper peripheral edge surface 15, can be permitted. After reading this disclosure and reviewing the accompanying drawings, a number of such means would likely occur to one skilled in the art. Except as it may be expressly limited, each such means is within the scope of the present invention.

One potential means for preventing relative sliding between the protective collar 50 and the upper peripheral edge surface 15 is shown in the embodiment of FIGS. 5 through 8. There, the means for preventing relative sliding comprises a plurality of stops 54 that have a portion thereof projecting beyond the flat bottom surface of the body portion 52. More particularly, the stops 54 comprise L-shaped brackets with a first leg 51 fixed to the upper surface of the body portion 52 and a second leg 53 projecting downwardly below the lower surface of the body portion 52. With that, the second legs 53 of the stops 54 can make contact with the outside edges of the sidewall 12 thereby to prevent sliding of the protective collar 50. Where the stops 54 are disposed over less than 180 degrees around the body portion 52, sliding of the body portion 52 onto the upper edge surface 15 of the sidewall 12 will be permitted until the stops 54 contact the sidewall 12. At that point, sliding in a first direction, in this case further toward the lid 14, is prevented while sliding in a second direction, in this case away from the lid 14 and off of the sidewall 12 to permit easy removal of the protective collar 50, is permitted.

In the depicted embodiment, there are four stops 54 with one retained relative to each of four adjacent facets of the eight-facet protective collar 50. With that, the stops 54 span over less than 180 degrees around the body portion 52. The stops 54 can be retained in any suitable manner and could potentially be molded with or directly into the body portion 52. In the depicted embodiment, the stops 54 are retained by fasteners 57 that are received through the stops 54 and into apertures 59 in the body portion 52.

It is contemplated within the scope of the invention to provide a means for providing alternate positioning of the stops 54, which could be advantageous where a given kiln 10 has an obstruction, such as a handle or the like (not shown), where a stop 54 might otherwise be located. In the present embodiment, the means for providing alternate positioning of the stops 54 comprises alternate fastening apertures 59. Here, the body portion 52 has apertures 59 spaced over each of the four facets. More particularly, there are three sets of fastening apertures 59 for each facet to enable a selective positioning of the stops 54.

Figure 11:
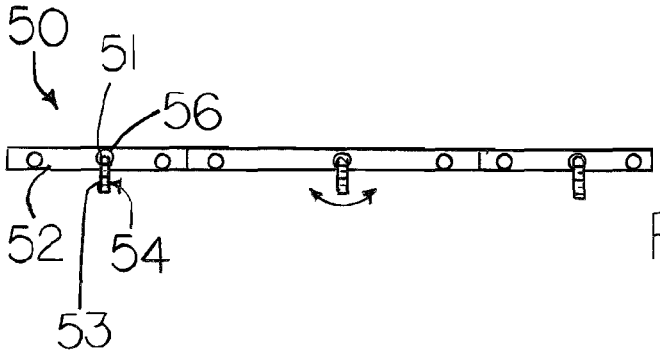
FIG. 11 is a view in front elevation of another protective collar under the present invention.

An alternative stop arrangement is depicted in relation to the protective collar 50 of FIG. 11. In this embodiment, the stops 54 have L-shaped bodies with a first leg 51 for being received into a borehole 56 in the edge of the body portion 52 and a second leg 53 for selectively acting as a means for preventing relative sliding of the protective collar 50. The first leg 51 of each stop 54 is threaded and is engaged with the threaded borehole 56. The stops 54 are thus pivotably retained relative to the body portion 52 such that the stops 54 can be pivoted from a first position where the second leg 53 projects beyond the lower surface of the body portion 52 as in FIG. 11 to a second position where the second leg 53 is generally parallel to the upper and lower surfaces of the body portion 52. A possible alternative to the threaded stop 54 and threaded borehole 56 is contemplated wherein the stop 54 is a spring loaded swiveling device, similar to a bicycle kickstand arrangement.

Such a pivoting can facilitate shipping and storage. Furthermore, the stops 54 can be pivoted to a non-obtrusive position to permit the application of the protective collar 50 despite obstacles on the kiln 10 that might otherwise interfere with the application of the protective collar 50. The embodiment of FIG. 11 also includes means for providing alternate positioning of the stops 54 in the form of additional boreholes 56 spaced along the respective facets of the body portion 52 of the protective collar 50.

In a typical method for using the protective collar 50 disclosed herein, an artisan will preferably first select a protective collar 50 that substantially matches the shape and size of the upper peripheral edge surface 15 of his or her kiln 10. After opening the lid 14, the artisan can then apply the protective collar 50 to the kiln 10 with the lower surface of the body portion 52 facing the upper peripheral surface 15 of the sidewall 12. Where one or more stops 54 are provided, the artisan can position the protective collar 50 with the stops 54 contacting the outer surface of the sidewall 12. If necessary, stops 54 can be relocated to avoid obstacles on the outer surface of the sidewall 12. Where the kiln 10 is a shape other than round, the artisan can ensure that the orientation of the body portion 52 is aligned with the orientation of the sidewall 12. Articles, such as ceramics and kiln furniture, can then be inserted into the firing chamber 16 with minimized risk of damage to the upper peripheral edge surface 15. The protective collar 50 can then be removed, the lid 14 partially or entirely closed, and the kiln 10 heated to produce the desired heating effect. When the artisan determines one or more articles are to be removed, the lid 14 can be reopened, the protective collar 50 can be reapplied as described above, and the articles can be removed, again with minimized risk to the firebrick of the sidewall 12.

As shown and described, the protective collar 50 for kilns 10 can enable a user to prevent wear and damage in relation to the upper edge surface 15 of the kiln 10. With that, the protective collar 10 can increase the useful life of the kiln 10 and reduce the need for repairs thereto. By preserving the upper peripheral edge surface 15, the protective collar 50 enables a tight seal between the lid 14 and the upper edge surface 15 to be maintained thereby improving energy efficiency and firing quality while preventing the deleterious effects of escaping gasses. Even further, when the protective collar 50 is shaped and sized within an acceptable range of the shape and size of the upper peripheral edge surface 15, full or substantially full dimensional access to the firing chamber 16 will be permitted for loading and unloading even as the collar 50 protects the fragile firebrick at the upper edge surface 15 of the kiln 10. Still further, with the firebrick protected, the user need not be quite as cautious in leaning over the kiln to load and unload objects thereby improving comfort and ease while saving precious time in loading and unloading articles relative to the kiln 10.

With certain details of the present invention for a protective collar 50 for kilns 10 disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A protective collar for a kiln with a peripheral kiln sidewall that has an upper peripheral edge surface of a given shape, size, and thickness, the protective collar comprising:

a rigid body portion with an upper surface, a lower surface consisting of a flat lower surface, an inner edge, an outer edge, and a shape and size substantially corresponding to the shape and size of at least a portion of the upper peripheral edge surface of the kiln sidewall whereby the flat lower surface of the body portion can be disposed to rest atop the upper peripheral edge surface of the kiln sidewall and whereby the flat lower surface of the body portion can be slid relative to the upper peripheral edge surface of the kiln sidewall from alignment with the upper peripheral edge surface, across, and off of the upper peripheral edge surface.

2. The protective collar of claim 1 wherein the protective collar is for a kiln with a peripheral edge surface with a faceted shape and wherein the body portion of the protective collar has a given number of facets substantially corresponding in size, shape, and disposition to at least some of the facets of the peripheral edge of the kiln sidewall.

3. The protective collar of claim 2 wherein the body portion of the protective collar has facets corresponding in size, shape, and disposition to a plurality of facets of a kiln with a peripheral edge surface with between 5 and 20 facets.

4. The protective collar of claim 3 wherein the body portion of the protective collar has facets corresponding in size, shape, and disposition to a plurality of facets of a kiln with a peripheral edge surface with 8, 10, or 12 facets.

5. The protective collar of claim 2 wherein the body portion has a width approximately equal to the thickness of the peripheral edge surface of the kiln sidewall, an inner dimension between opposed inner edges approximately equal to an inner dimension between opposed inner edges of the peripheral edge surface, and an outer diameter between opposed outer edges approximately equal to an outer dimension between opposed outer edges of the peripheral edge surface.

6. The protective collar of claim 5 wherein the body portion has a width within thirty percent of the thickness of the peripheral edge surface of the kiln sidewall.

7. The protective collar of claim 1 further comprising means for preventing dislocation of the protective collar relative to the peripheral edge surface of the kiln sidewall when the protective collar is applied in alignment with the peripheral edge surface of the kiln sidewall.

8. The protective collar of claim 7 wherein the means for preventing dislocation of the protective collar relative to the peripheral edge surface of the kiln sidewall comprises a means for preventing sliding in a first direction across the upper peripheral edge surface when the protective collar is applied in alignment with the peripheral edge surface while permitting sliding in a second direction opposite the first direction across and off of the peripheral edge surface.

9. The protective collar of claim 8 wherein the means for preventing dislocation of the protective collar relative to the peripheral edge surface of the kiln sidewall comprises at least one stop fixed to the body portion wherein the stop has a portion that projects beyond the lower surface of the body portion.

10. The protective collar of claim 9 wherein the means for preventing dislocation of the protective collar relative to the peripheral edge surface of the kiln sidewall comprises a plurality of stops spaced over less than a 180-degree span along the body portion of the protective collar.

11. The protective collar of claim 9 wherein the at least one stop is pivotable from a first position where the at least one stop does not project beyond the lower surface of the body portion and a second position where the at least one stop projects beyond the lower surface of the body portion.

12. The protective collar of claim 11 wherein the at least one stop is L-shaped with a first leg received into a borehole in the outer edge of the body portion of the protective collar and a second leg pivotable from a first position where the second leg does not project beyond the lower surface of the body portion and a second position where the second leg projects beyond the lower surface of the body portion.

13. The protective collar of claim 9 further comprising a means for enabling alternate positioning of the at least one stop wherein the at least one stop is L-shaped with a first leg received into a borehole in the outer edge of the body portion of the protective collar and a second leg that projects beyond the lower surface of the body portion wherein the means for enabling alternate positioning of the at least one stop comprises a plurality of alternate boreholes in the outer edge of the body portion of the protective collar.

14. The protective collar of claim 1 wherein the body portion forms a complete ring for entirely encircling the kiln sidewall.

15. The protective collar of claim 1 wherein the body portion spans at least approximately 120 degrees of a circumference of the peripheral edge surface.

16. A method for employing a protective collar to protect an upper peripheral edge surface of a kiln, the method comprising the following steps:

providing a kiln with a peripheral kiln sidewall that has an upper peripheral edge surface of a given shape, size, and thickness;

selecting a protective collar with a rigid body portion with an upper surface, a lower surface, an inner edge, an outer edge, and a shape and size approximately corresponding to the shape and size of at least a portion of the upper peripheral edge surface of the kiln sidewall wherein the lower surface consists of a flat lower surface whereby the flat lower surface can be slid relative to the upper peripheral edge surface of the kiln sidewall and whereby the flat lower surface can be disposed to rest atop the upper peripheral edge surface of the kiln sidewall; and applying the protective collar to the kiln with the flat lower surface of the body portion facing the peripheral edge surface of the kiln sidewall and with the shapes of the protective collar and the peripheral edge surface substantially aligned.

17. The method of claim 16 wherein the step of providing a kiln comprises providing a kiln with a peripheral edge surface with a number of facets and wherein the step of providing a protective collar comprises the step of providing a protective collar with a body portion having facets of substantially the same shape, size, and disposition as at least some of the facets of the peripheral edge surface of the kiln sidewall.

18. The method of claim 16 further comprising the steps of loading articles relative to the kiln while the protective collar is applied to the peripheral edge surface of the kiln operating the kiln, and removing the protective collar from the peripheral edge surface of the kiln prior to operating the kiln.

19. The method of claim 16 wherein the step of selecting a protective collar further comprises selecting a protective collar with a plurality of stops retained by the body portion of the protective collar wherein the stops are spaced over less than a 180-degree span along the body portion of the protective collar wherein each stop has a portion that projects beyond the lower surface of the body portion.

20. The method of claim 16 wherein the step of selecting a protective collar comprises selecting a protective collar with a body portion that forms a complete ring.

21. A top loading kiln and protective collar combination comprising:

a top loading kiln with a peripheral kiln sidewall that has an upper peripheral edge surface of a given shape, size, and thickness;

a protective collar with a rigid body portion consisting of a flat panel with a flat upper surface, a flat lower surface, an inner edge, an outer edge, and a shape and size substantially corresponding to the shape and size of at least a portion of the peripheral edge surface of the kiln sidewall whereby the flat lower surface of the body portion can be disposed to rest atop the upper peripheral edge surface of the kiln sidewall and whereby the flat lower surface of the body portion can be slid relative to the upper peripheral edge surface of the kiln sidewall from alignment with the upper peripheral edge surface, across, and off of the upper peripheral edge surface.

22. The kiln and protective collar combination of claim 21 wherein the kiln has an upper peripheral edge surface with a faceted shape with a number of facets and wherein the body portion of the protective collar has a given number of facets corresponding to the number of facets of the upper peripheral edge surface of the kiln sidewall.

23. The kiln and protective collar combination of claim 21 wherein the body portion of the protective collar has a width approximately equal to the thickness of the upper peripheral edge surface of the kiln sidewall, an inner dimension between opposed inner edges approximately equal to an inner dimension between opposed inner edges of the upper peripheral edge surface, and an outer diameter between opposed outer edges approximately equal to an outer dimension between opposed outer edges of the upper peripheral edge surface.

24. The kiln and protective collar combination of claim 21 further comprising means for preventing dislocation of the protective collar relative to the upper peripheral edge surface of the kiln sidewall when the protective collar is applied in alignment with the peripheral edge surface of the kiln sidewall wherein the means for preventing dislocation of the protective collar relative to the peripheral edge surface of the kiln sidewall comprises a means for preventing sliding in a first direction across the upper peripheral edge surface when the protective collar is applied in alignment with the peripheral edge surface while permitting sliding in a second direction opposite the first direction from when the protective collar is applied in alignment with the peripheral edge surface, across, and off of the peripheral edge surface.

25. The kiln and protective collar combination of claim 24 wherein the means for preventing dislocation of the protective collar relative to the upper peripheral edge surface of the kiln sidewall comprises at least one stop retained by the body portion of the protective collar wherein the stop has a portion that projects beyond the lower surface of the body portion.

26. The kiln and protective collar combination of claim 25 wherein the means for preventing dislocation of the protective collar relative to the upper peripheral edge surface of the kiln sidewall comprises a plurality of stops spaced over less than a 180-degree span along the body portion of the protective collar.

27. The kiln and protective collar combination of claim 25 wherein the at least one stop is pivotable from a first position where the at least one stop does not project beyond the lower surface of the body portion and a second position where the at least one stop projects beyond the lower surface of the body portion.

* * * * *